US010882061B2

(12) United States Patent
Nikles

(10) Patent No.: US 10,882,061 B2
(45) Date of Patent: Jan. 5, 2021

(54) DELIVERY DEVICE OF A WATER JET WITH SAFETY VALVE

(71) Applicant: NIKLES TEC ITALIA S.r.l., Carpenedolo (IT)

(72) Inventor: Gerhard Nikles, Carpenedolo (IT)

(73) Assignee: NIKLES TEC ITALIA S.R.L., Carpenedolo (IT)

( * ) Notice: Subject to any disclaimer, the term of this patent is extended or adjusted under 35 U.S.C. 154(b) by 54 days.

(21) Appl. No.: 16/229,926

(22) Filed: Dec. 21, 2018

(65) Prior Publication Data

US 2020/0023387 A1 Jan. 23, 2020

(30) Foreign Application Priority Data

Jul. 20, 2018 (EP) ..... 18425055

(51) Int. Cl.
*B05B 1/18* (2006.01)
*B05B 1/16* (2006.01)

(52) U.S. Cl.
CPC ..... *B05B 1/185* (2013.01); *B05B 1/1609* (2013.01)

(58) Field of Classification Search
CPC ..... B05B 1/185; B05B 1/1609; B05B 1/3006; B05B 1/323; B05B 1/18; F16K 15/063; F16K 17/04; F16K 17/0446; F16K 17/08; Y10T 137/7868; Y10T 137/7933
USPC ..... 239/548, 76, 93–94, 109, 340, 347, 239/533.1; 137/462
See application file for complete search history.

(56) References Cited

U.S. PATENT DOCUMENTS

2013/0284285 A1* 10/2013 Reifenberger ..... F16K 15/063 137/334
2017/0043358 A1* 2/2017 Zhang ..... B05B 1/1618
2019/0224696 A1* 7/2019 Melle ..... B05B 15/654

FOREIGN PATENT DOCUMENTS

CN 202527296 U * 11/2012 ..... B05B 1/18
CN 104971834 A * 10/2015 ..... B05B 1/18

* cited by examiner

*Primary Examiner* — Darren W Gorman
(74) *Attorney, Agent, or Firm* — Cittone Demers & Arneri, LLP; Henry J. Cittone; Antoaneta V. Tarpanova

(57) ABSTRACT

A delivery device of a water jet comprises a delivery chamber and a safety valve suitable for reducing the water pressure in the delivery chamber when the water pressure exceeds a preset pressure threshold. The safety valve comprises a hollow housing body, a valve cartridge inserted tightly into the hollow housing body, the cartridge defining a valve seat for the passage of water and an obturator movable between a closed position, wherein the obturator closes said valve seat, and an open position, wherein the obturator opens said valve seat when a pressure greater than the preset pressure threshold value acts on said obturator. A support body is connected in a removable way to the hollow housing body and has a bottom wall on which the valve cartridge rests and which is penetrated by through-openings for the evacuation to the exterior of the water present in the hollow housing body.

14 Claims, 8 Drawing Sheets

DELIVERY DEVICE OF A WATER JET WITH SAFETY VALVE

CROSS-REFERENCE TO RELATED APPLICATION

This application claims priority to European Patent App. No. 18425055.3, filed Jul. 20, 2018, the disclosure of which is incorporated by reference herein in its entirety.

FIELD OF THE INVENTION

The present invention concerns a delivery device of a water jet, for example a shower head or a hand shower, of the type that comprises a delivery head defining a delivery chamber, an inlet fitting suitable to connect fluidically with a water supply line in the delivery chamber, and a delivery plate wherein are obtained a plurality of water delivery nozzles in the delivery chamber.

BACKGROUND

In some embodiments, the delivery head is designed to generate a water jet in the form of rain, also having with a large diameter. The delivery chamber and thus the delivery plate may therefore be very large, particularly in a radial direction with respect to the direction of the incoming water flow. Such a configuration of the delivery head may lead to some water stagnation in the delivery chamber. If the water is particularly hard, over time such stagnation may cause clogging in the nozzles and thus the onset of a hazardous overpressure condition in the delivery chamber.

SUMMARY OF THE INVENTION

One object of the present invention is to propose a water jet delivery device capable of overcoming the inconvenience cited above.

Another object of the invention is to enable convenient and rapid maintenance of the delivery device and thus to extend its service life.

Such objects are achieved by a delivery device in accordance with claim 1. The dependent claims describe preferred or advantageous embodiments of the delivery device.

BRIEF DESCRIPTION OF THE DRAWINGS

The features and advantages of the delivery device according to the invention will, however, become evident from the description hereinafter of their preferred embodiments, provided by way of indicative and non-limiting example, with reference to the accompanying figures, wherein.

DETAILED DESCRIPTION

In said drawings, a delivery device of a water jet according to the invention is indicated collectively at 1; 100.

In the example illustrated in FIGS. 1-7, the delivery device is a shower head 1, also called a "rain shower head" which is suitable for delivering a rainwater jet facing downward from above.

Figure 1:
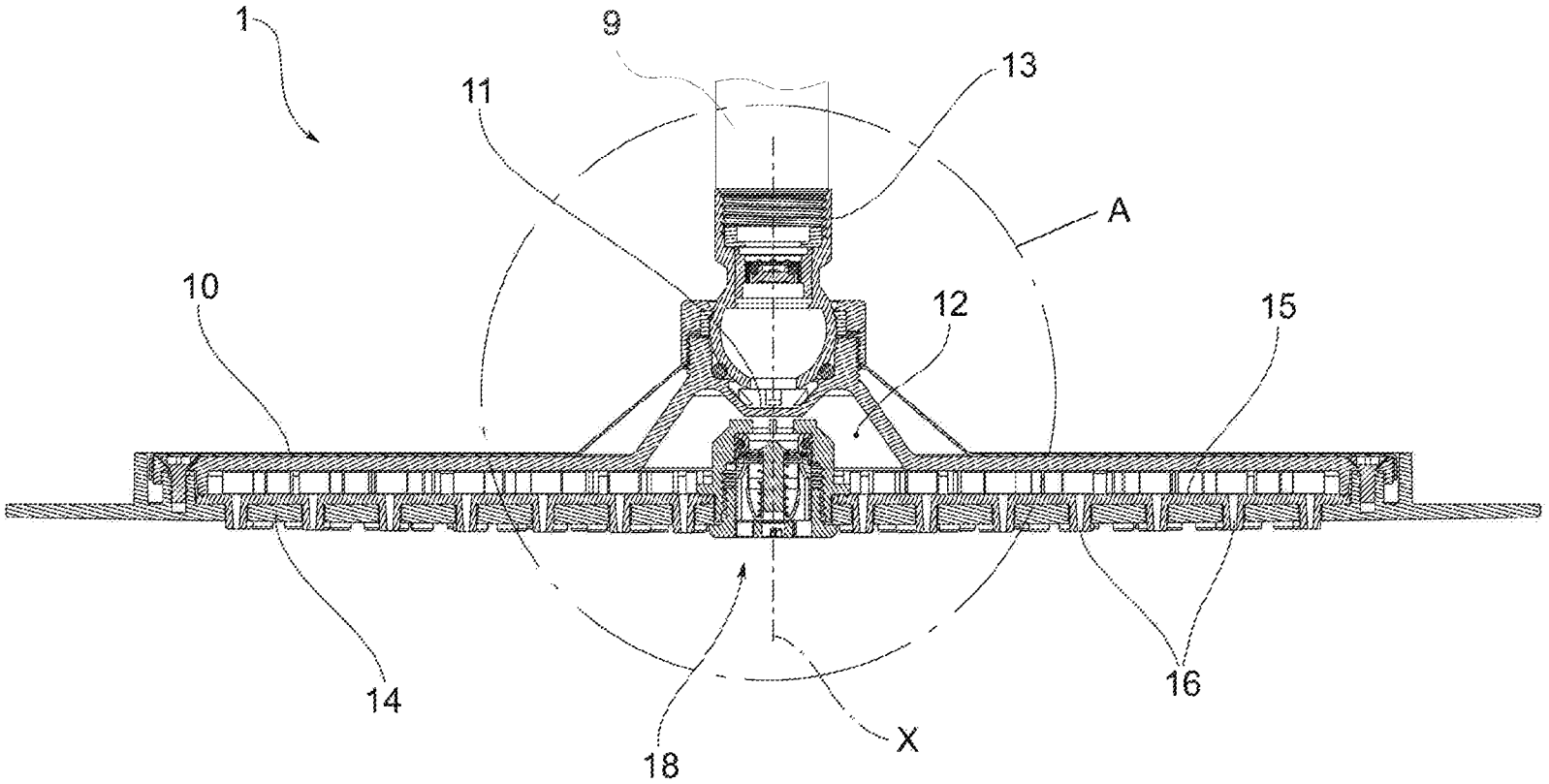
FIG. 1 is an axial section of a shower head according to the present invention.
Figure 2A:
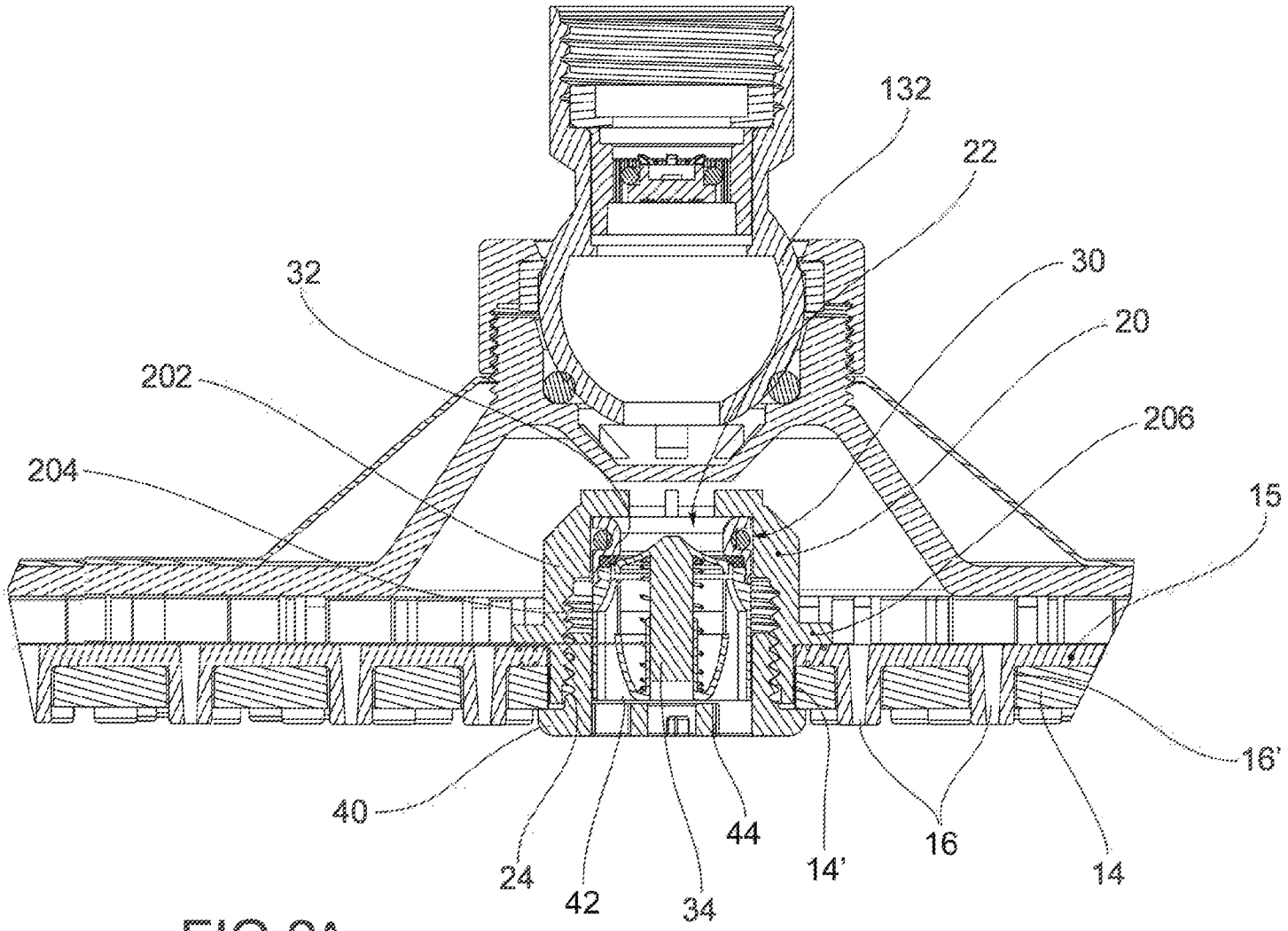
FIG. 2A is an enlarged view of the detail A circled in FIG. 1.
Figure 2B:
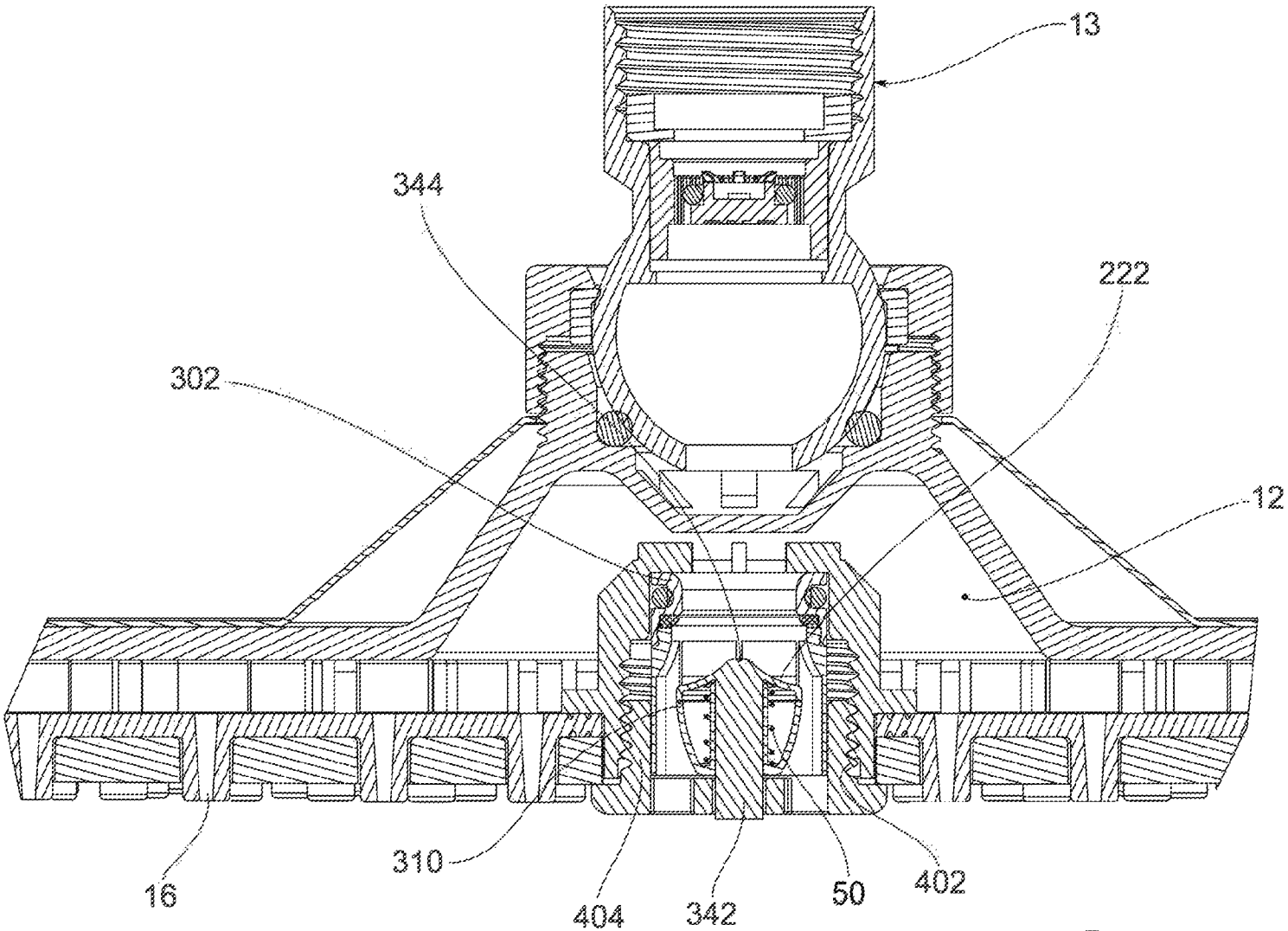
FIG. 2B is a similar view to the preceding one, but with the safety valve in an open position.
Figure 3:
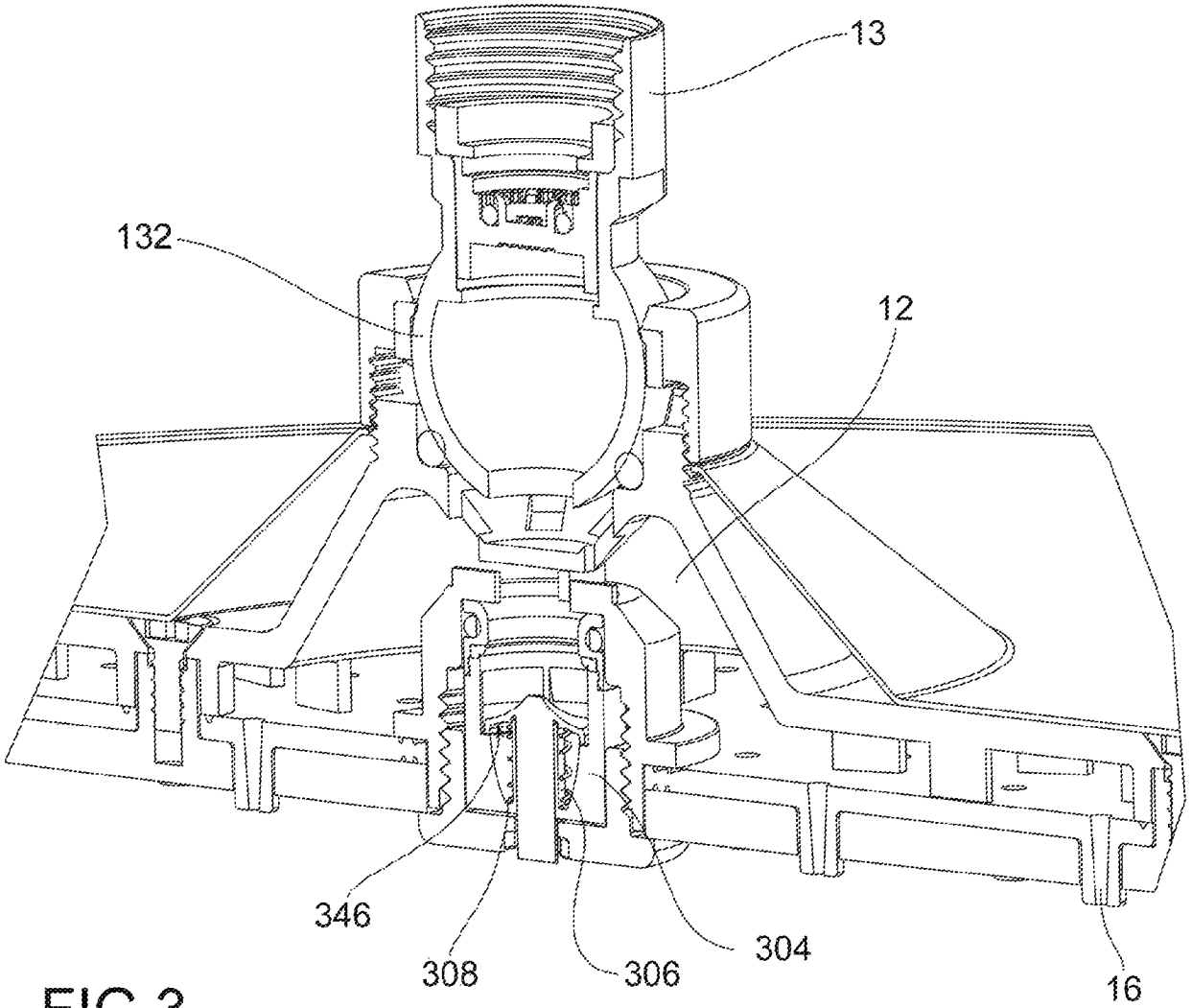
FIG. 3 is an axial section view similar to the preceding one, but in perspective view.
Figure 4:
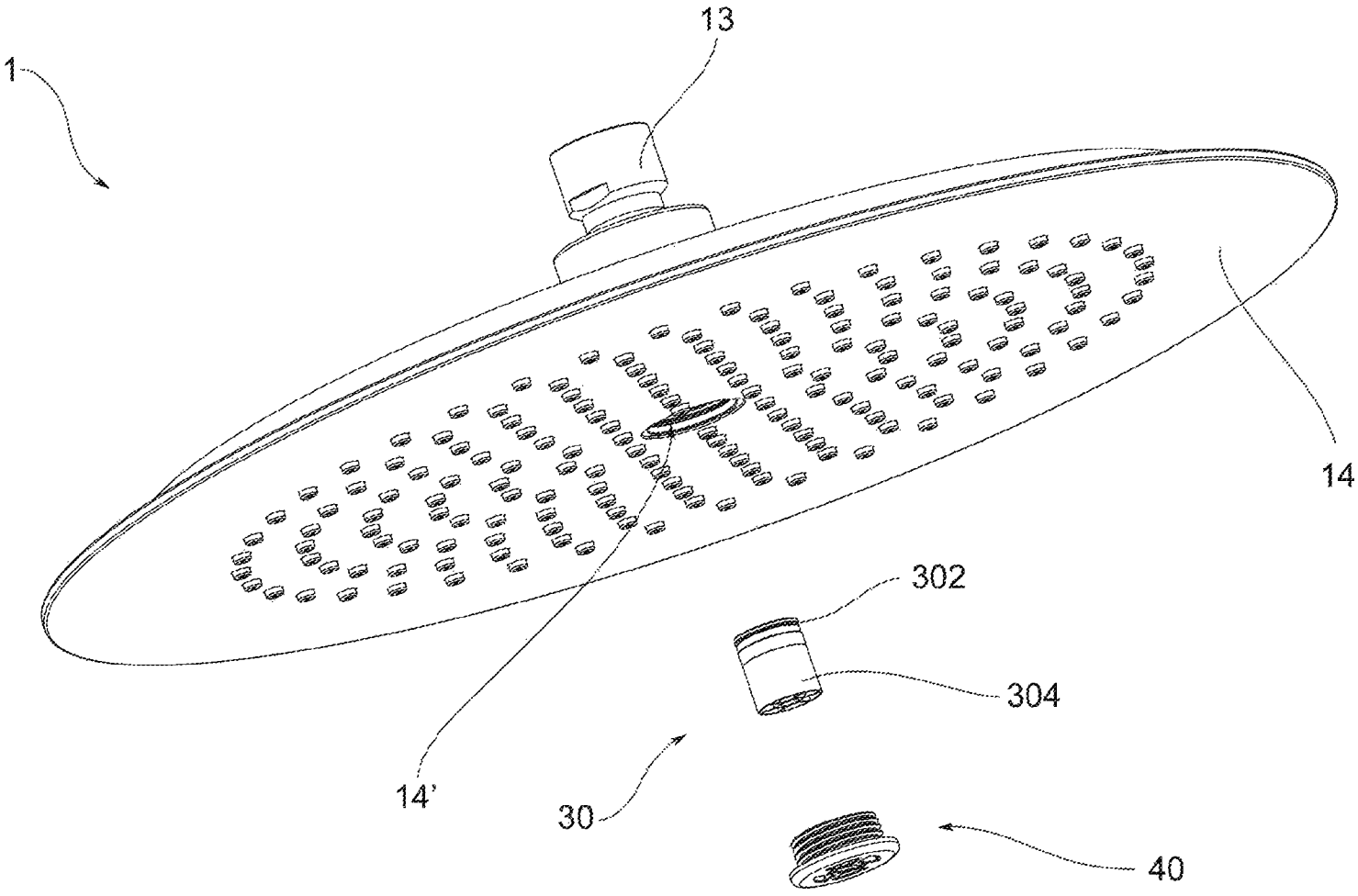
FIG. 4 is an exploded perspective view of the shower head.
Figure 5:
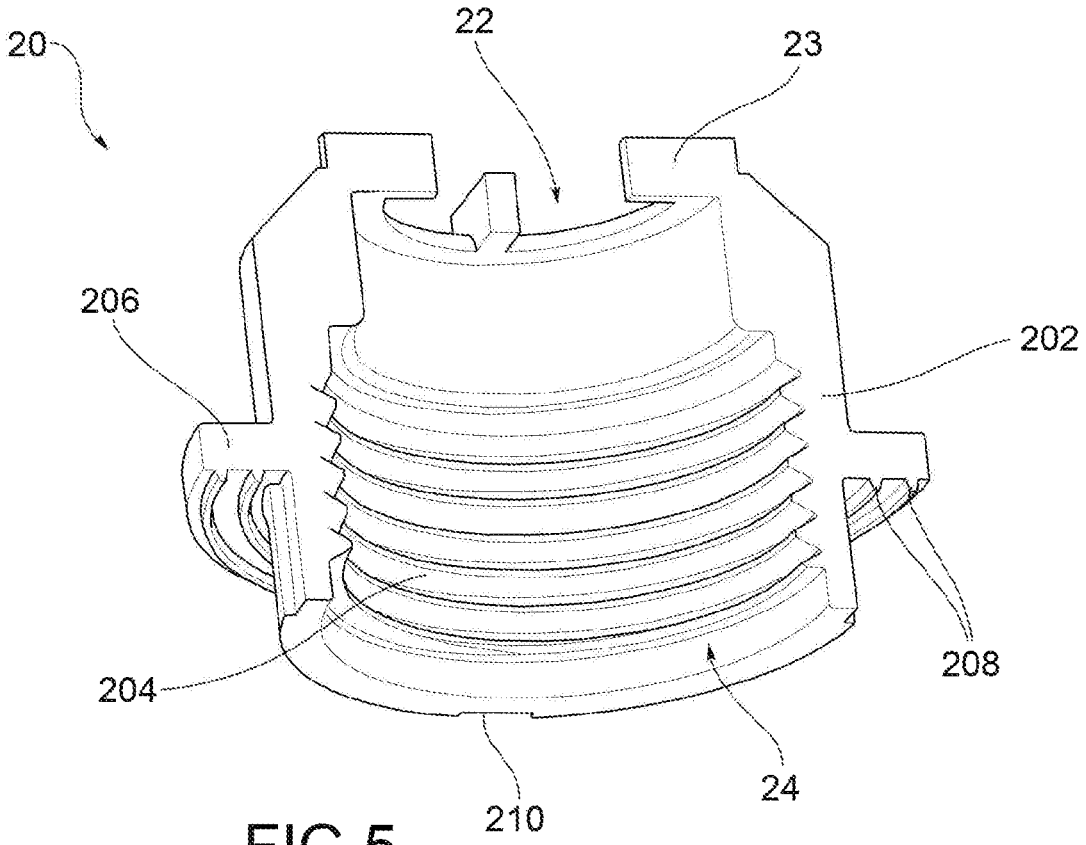
FIG. 5 is a perspective view in axial section of the hollow housing body of the safety valve.
Figure 6:
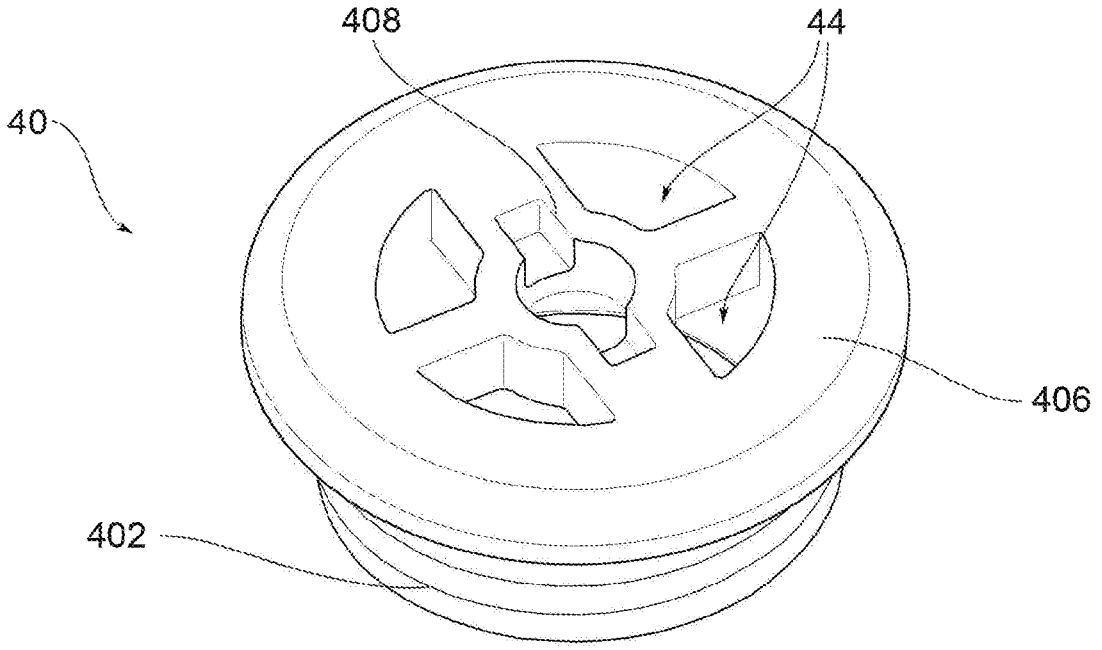
FIG. 6 is a perspective view of the support body of the safety valve.
Figure 7:
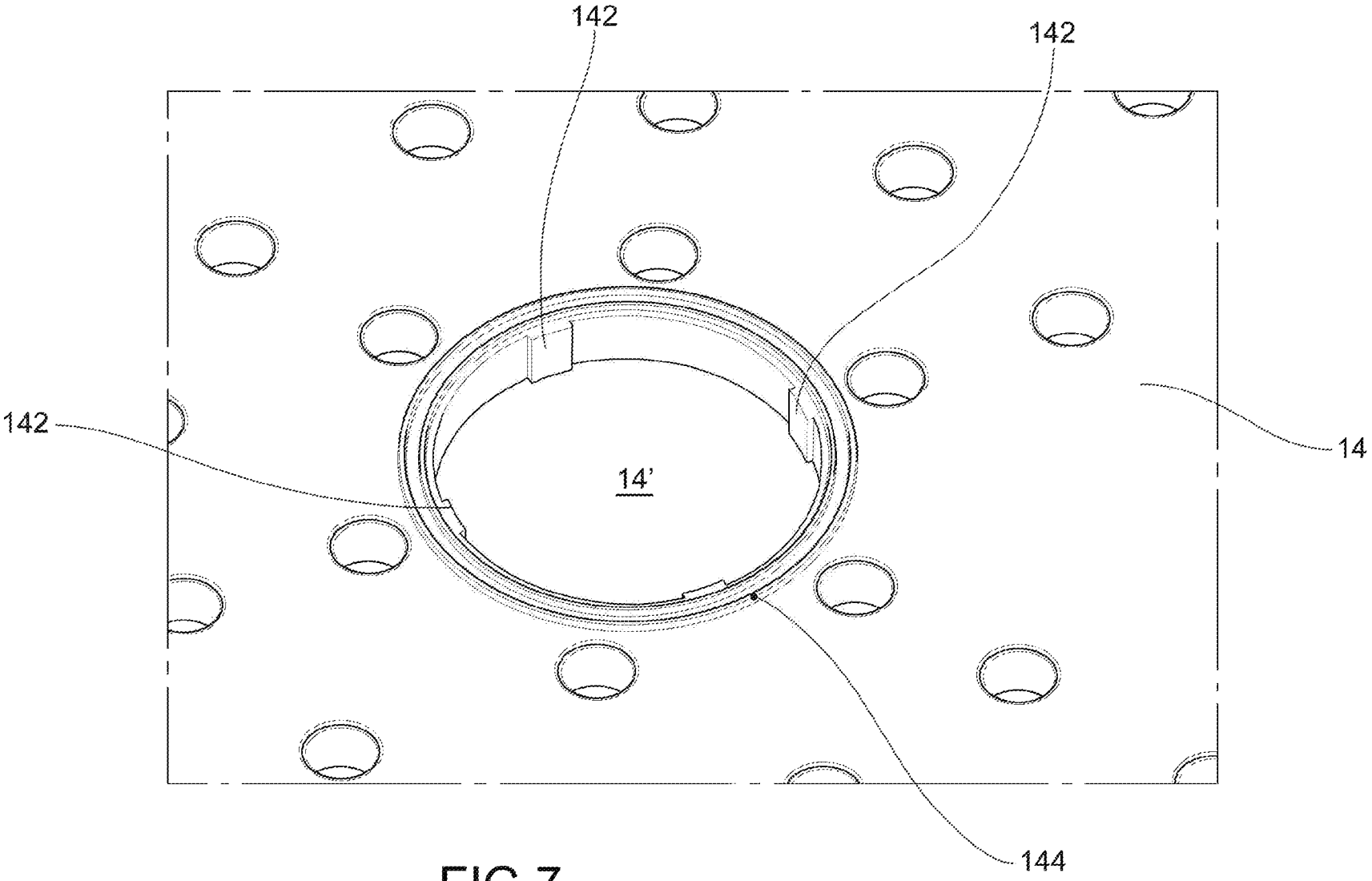
FIG. 7 is a perspective view of a central portion of the delivery plate of the shower head.
Figure 8:
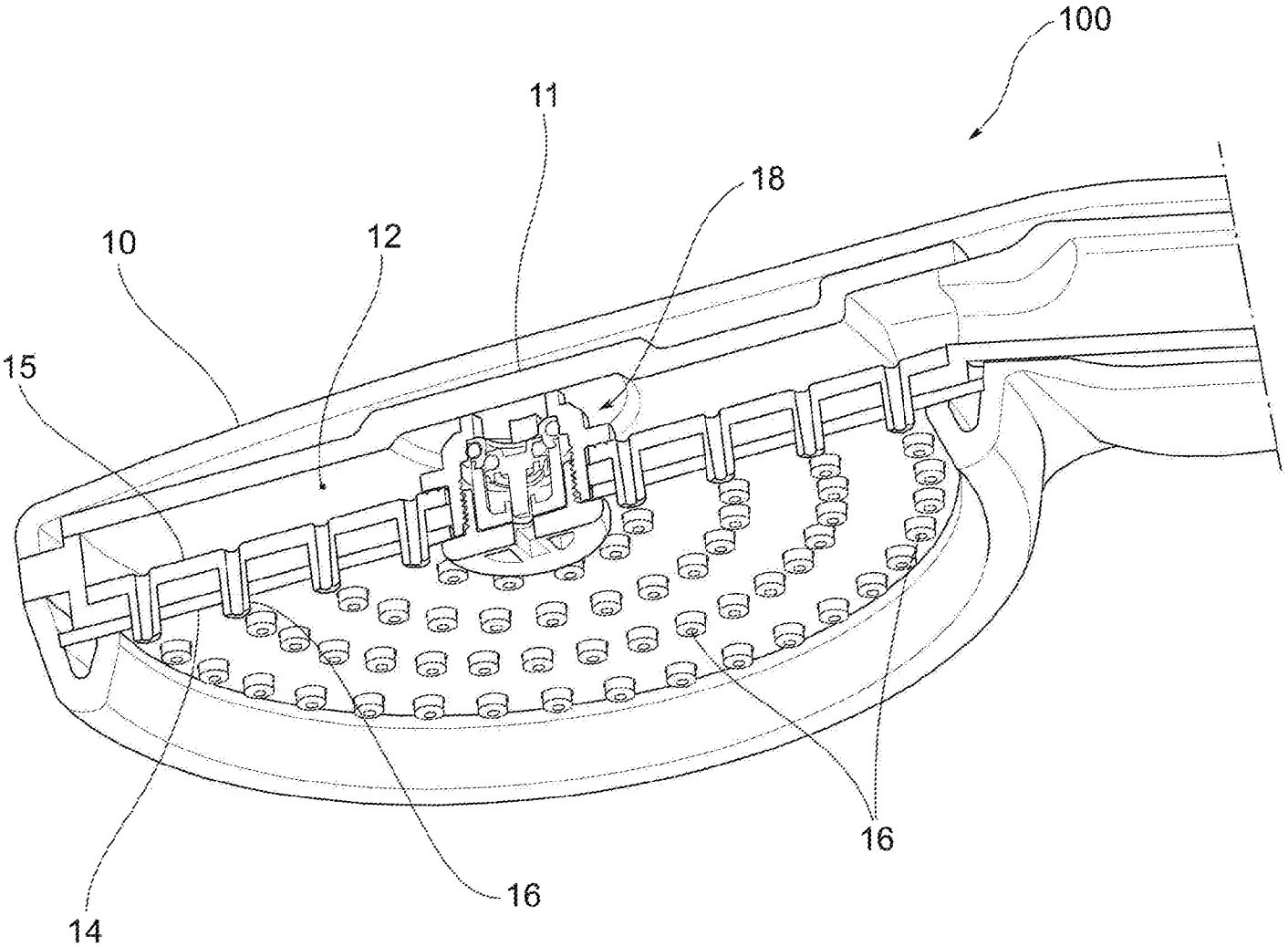
FIG. 8 is a perspective view in axial section of the delivery head of a hand shower according to the invention.

In the example illustrated in FIG. 8, the delivery device is a hand shower 100.

It is clear, however, to one skilled in the art, that the teaching provided by the present invention may be applied to any delivery device of a fluid that may be subject to the risk of an unwanted increase in the pressure of the fluid therein.

In the following description, the elements common to the various embodiments are indicated at the same numeric references.

According to a general embodiment, the delivery device 1; 100 comprises a delivery head 10 defining a delivery chamber 12. The delivery head 10 comprises an inlet fitting 13 suitable for connecting fluidically, e.g. by screwing, to a water supply line 9 in the delivery chamber 12.

In the case of the shower head 1, the inlet fitting 13 may include a ball joint 132 to allow the delivery head 10 to oscillate with respect to the water supply line.

A delivery plate 14 closes at least one side of the delivery chamber 12, for example, in the case of the rain shower head shown in the drawings, the underside.

The delivery plate 14 contains a plurality of nozzles 16 for delivering water present in the delivery chamber 12.

A safety valve 18 is attached to the delivery plate 14 suitable for reducing the water pressure in the delivery chamber 12 when the water pressure exceeds a preset pressure threshold.

The safety valve 18 comprises a hollow housing body 20 which passes through the delivery plate 14. A through-hole 14' is therefore made in the delivery plate 14, wherein is inserted, with fluid-tight shape-coupling, the hollow housing body 20.

The hollow housing body 20 is in fluid communication with the delivery chamber 12 through an inner body opening 22.

The hollow housing body 20 is open to the exterior, i.e. in the output direction of the water jet coming out of the delivery nozzles 16, through an outer body opening 24. In other words, the outer body opening 24 faces in the direction of the water delivery from the delivery nozzles 16.

The safety valve 18 comprises a valve cartridge 30 sealingly inserted in the hollow housing body 20.

The valve cartridge 30 defines a valve seat 32 which, when in an open condition, allows the passage of water from the inner body opening 22 to the outer body opening 24.

The valve cartridge 30 comprises an obturator 34 movable between a closed position, wherein it closes the valve seat 32, and an open position, wherein the obturator 34 opens the valve seat 32 when a pressure higher than the preset pressure threshold value acts on the obturator 34.

In addition, the safety valve 18 comprises a support body 40 which is connected in a removable way to the outer body opening 24 of the hollow housing body 20. The support body 40 has a bottom wall 42 on which rests the valve cartridge 30 and which is penetrated by through openings 44 for the evacuation to the outside of the water present in the hollow housing body 20.

In one embodiment, the safety valve 18 has an axially symmetrical shape, e.g. an overall cylindrical shape, and extends around a valve axis X that is substantially parallel to the direction of delivery of the water jet.

In one embodiment, the hollow housing body 20 and the support body 40 are connected to each other by means of a threaded connection. For example, the hollow housing body 20 has a side wall 202 which, at least in a portion thereof facing the outer body opening 24, has an inner thread 204 wherein is screwed a corresponding outer thread 402, obtained on a side wall 404 of the support body 40.

In one embodiment, the side wall 404 of the support body 40 extends from a base 406 with a larger diameter than the outer diameter of the side wall 202 of the hollow housing body at the outer body opening 24.

In one embodiment, in one portion of the support body accessible from the outside, for example in the base 406, a recess 408 is obtained suitable for being engaged by a tool, such as a screwdriver, for coupling/uncoupling the support body 40 to/from the hollow housing body 20.

In one embodiment, a spacer grid 23 is made on an inner body opening 22, e.g. consisting of radial projections extending from the side wall 202 to the valve axis X, which allows the hollow housing body 20 also to rest against a top wall 11 of the delivery head 10, opposite the delivery plate 14, without blocking the inner body opening 22, e.g. if the hollow body 20 is pushed axially towards the top wall 11 when applying the support body 40 to the hollow housing body.

In the example of the hand shower illustrated in FIG. 8, one may note the spacer grid 23 abutting against the top wall 11 of the delivery head 10.

The spacer grid 23, abutting against the top wall 11, also prevents the hollow housing body 20 from completely disengaging from the through-hole 14' when applying the support body 40.

In one embodiment, the hollow housing body 20 has an annular flat portion 206 which extends radially from the outer surface of the side wall 202 to abut against the inner side of the delivery plate 14 to secure the hollow housing body 20 to the delivery plate 14.

In particular, in the case of a threaded coupling between the hollow housing body 20 and the support body 40, when the support body 40 is screwed to the hollow housing body 20, the base 406 of the support body 40 abuts against the outer side of the delivery plate 14. At this point, the additional screwing of the support body 40 generates a tensile force on the hollow housing body 20, which is directed towards the support body 40. The flat, annular portion 206 is then compressed against the inner side of the delivery plate 14 and the safety valve is locked to such delivery plate 14.

In one embodiment, the surface of the flat, annular portion 206 facing the delivery plate has at least one sharp, annular ridge 208 suitable to press on the delivery plate 14 so that a hermetic seal is created between the delivery plate 14 and the hollow housing body 20.

In an embodiment that provides for screwing between the hollow housing body 20 and the support body 40, anti-rotation means of the hollow housing body are provided with respect to the delivery plate 14. For example, the side wall 202 of the hollow housing body may be equipped with radial recesses 210 engaged by respective radial teeth 142 extending from the wall delimiting the through hole 14'.

Returning now to the valve cartridge 30, in one embodiment, the obturator 34 is translatable in the valve cartridge 30 between an advanced closed position of the valve seat 32 and a retracted open position of the valve seat 32. For example, the obturator 34 is translatable along the valve axis X. Considering, as in the example shown, the delivery device 1 oriented so as to direct the water flow in a substantially vertical direction, the obturator 34 is translatable between a raised closed position of the valve seat 32 and a lowered open position of the valve seat 32.

In one embodiment, the obturator 34 is normally held in the closed position by an elastic element 50 located in the valve cartridge 30. The elastic element 50 is calibrated so as to give way when the water pressure acting on the obturator 34 exceeds the preset pressure threshold.

In one embodiment, the elastic element 50 is a spring, e.g. a helical cylindrical spring.

In one embodiment, the valve cartridge 30 comprises an annular end portion 302 which hermetically engages a side end wall 222 of the hollow housing body 20 which delimits the inner body opening 20. Therefore, this annular end portion 302 forms the valve seat 32 that is engaged by the obturator 34.

The valve cartridge 30 comprises moreover an obturator support cage 304, wherein are obtained an obturator guide seat 306 and an elastic element seat 308. The obturator guide seat 306 supports the obturator 34 in a guided manner and with the possibility of translation; the elastic element seat 308 supports the elastic element 50 in a guided manner.

In one embodiment, the obturator 34 comprises an obturator stem 342 guided in a tubular portion of the valve cartridge that forms the obturator guide seat, and an obturator head 344 suitable to engage the valve seat. For example, the obturator head 344 has a convex shape with a maximum diameter greater than the inside diameter of the valve seat 32, so that the obturator head 344 engages an inside edge of the valve seat 32 when the obturator 34 moves from the retracted to the advanced position.

Moreover, the obturator head 344 forms with the obturator stem 342 an undercut 346 wherein it engages the elastic element 50 to push the obturator into the closed position.

For example, the elastic element seat 308 extends coaxially around the tubular portion 306.

In one embodiment, the retracted position of the obturator 34 is defined by a stop collar 310 made in the valve cartridge 30, for example, in one piece with the obturator support cage 50, to support the obturator 34 when it moves from the advanced closed position to the retracted open position.

In one embodiment, the obturator stem 342, when it is found in the retracted position, is at least partially inserted also in the bottom wall 42 of the support body 40, which has, for this purpose, an obturator hole 406 coaxial to the tubular portion 306 of the obturator seat. For example, such obturator hole 406 is a through-hole, which also allows the user to visually check the position of the obturator 34.

In one embodiment, the delivery plate 14 is substantially flat and the safety valve 18 is positioned in the center of the delivery plate 14.

In one embodiment, a soft membrane 15 is placed on the inside of the delivery plate 14 to form the delivery nozzles 16 which pass through the corresponding holes 16' made in the thickness of the delivery plate 14. In this case, preferably, the flat, annular portion 206 of the hollow housing body 20 rests on this soft membrane 15, e.g. pressing on it with the sharp, annular ridge 208. In this case, the inner side of the delivery plate 14 may also be provided with at least one plate sharp, annular ridge 144, which surrounds the through-hole 14', suitable to press on the soft membrane 15.

It is clear that the delivery device described above allows the predefined objects to be achieved.

In effect, if the water pressure inside the delivery chamber exceeds a preset threshold value, for example, due to the blockage of at least one part of the delivery nozzles, the elastic element gives way and the obturator moves to the open position of the valve seat, allowing the water to escape through the safety valve, and resulting, therefore, in a sudden reduction in the pressure inside the delivery chamber.

The safety valve may be easily and quickly disassembled by accessing the support body and disconnecting it from the hollow housing body, for example, with a screwdriver. This allows the inside of the valve to be inspected and the valve cartridge to be replaced if necessary.

To the embodiments of the delivery device according to the invention, those skilled in the art, to satisfy contingent needs, may make modifications, adaptations and replacements of some elements with others that are functionally equivalent, without departing from the scope of the following claims. Each of the features described as belonging to a possible embodiment may be implemented independently from the other described embodiments.

The invention claimed is:

1. A delivery device of a water jet, comprising a delivery head defining a delivery chamber, where said head comprises:

an inlet fitting suitable for connecting fluidically a water supply line with the delivery chamber, and a delivery plate having an inner side and a center, wherein are obtained a plurality of water delivery nozzles present in the delivery chamber, wherein a safety valve is fixed to said delivery plate suitable for reducing water pressure in the delivery chamber when the water pressure exceeds a preset pressure threshold, said safety valve comprising:

a hollow housing body which passes through and is integral with the delivery plate, wherein said hollow housing body is in fluidic communication with the delivery chamber through an inner body opening and is open to the exterior of the delivery device through an outer body opening facing in a direction of delivery of the water by the plurality of delivery nozzles;

a valve cartridge inserted into the hollow housing body, the cartridge defining a valve seat for the passage of water from the inner body opening to the outer body opening and comprising an obturator movable between a closed position, wherein the obturator closes said valve seat, and an open position, wherein the obturator opens said valve seat when a pressure greater than the preset pressure threshold value acts on said obturator; and a support body connected in a removable way to the outer body opening of the hollow housing body, said support body having a bottom wall on which the valve cartridge rests and said support body having through-openings for evacuation of the water present in the hollow housing body to the exterior; wherein the support body comprises a threaded side wall suitable for screwing into the hollow housing body, and a base having a diameter larger than the outer diameter of a wall of the hollow housing body delimiting the outer body opening.

2. The delivery device according to claim 1, wherein the hollow housing body has a flat, annular portion that extends radially outwards therefrom and abuts against the inner side of the delivery plate when the support body is connected to the hollow housing body.

3. The delivery device according to claim 2, wherein when the support body is screwed into the hollow housing body, the flat, annular portion is compressed against the inner side of the delivery plate.

4. The delivery device according to claim 1, wherein the obturator is translatable in the valve cartridge between the closed position and the open position.

5. The delivery device according to claim 4, wherein the obturator is normally held in the closed position by an elastic element housed in the valve cartridge, the elastic element being calibrated so as to give way when the water pressure acting on the obturator exceeds the preset pressure threshold.

6. The delivery device according to claim 5, wherein said elastic element is a spring.

7. The delivery device according to claim 5, wherein the valve cartridge comprises:

an annular end portion which hermetically engages a side end wall of the hollow housing body which delimits the inner body opening, said annular end portion forming the valve seat; and an obturator support cage, wherein an obturator guide seat and an elastic element seat are obtained to provide guided support for the obturator and the elastic element.

8. The delivery device according to claim 7, wherein the obturator comprises an obturator stem guided into a tubular portion of the valve cartridge that forms said obturator guide seat, and an obturator head that forms an undercut with the obturator stem wherein the elastic element engages to push the obturator into the closed position.

9. The delivery device according to claim 8, wherein the elastic element seat extends coaxially about the tubular portion.

10. The delivery device according to claim 1, wherein the obturator is translatable in the valve cartridge between an advanced closed position of the valve seat and a retracted open position of the valve seat, said retracted position being defined by a stop collar obtained in the valve cartridge to support the obturator in its retracted position.

11. The delivery device according to claim 1, wherein the inner body opening is provided with a spacer grid that allows the hollow housing body to rest against a top wall of the delivery head, opposite the delivery plate, without obstructing the inner body opening.

12. The delivery device according to claim 1, wherein one portion of the support body has a recess suitable for being engaged by a tool for coupling or uncoupling the support body to or from the hollow housing body.

13. The delivery device according to claim 1, wherein the delivery head is a shower head or hand shower, where the delivery plate is substantially flat and where the safety valve is positioned in the center of the delivery plate.

14. The delivery device according to claim 12, wherein the recess is suitable for being engaged by a screwdriver for coupling or uncoupling the support body to or from the hollow housing body.

* * * * *